US005401004A

United States Patent [19]

Nestler et al.

[11] Patent Number: 5,401,004

[45] Date of Patent: Mar. 28, 1995

[54] METHOD AND APPARATUS FOR INSTALLING A NOZZLE INSERT IN A STEELMAKING LADLE

[75] Inventors: Alvin M. Nestler, Hellertown; John P. Hoffman, Coopersburg, both of Pa.; John L. Hogan, Chesterton; Edward T. Witek, Hobart, both of Ind.

[73] Assignee: Bethlehem Steel Corporation, Del.

[21] Appl. No.: 237,082

[22] Filed: May 3, 1994

Related U.S. Application Data

[63] Continuation-in-part of Ser. No. 25,543, Mar. 3, 1993, Pat. No. 5,335,896.

[51] Int. Cl.[6] ..... B22D 41/56

[52] U.S. Cl. ..... 266/45; 266/236; 222/591

[58] Field of Search ..... 266/45, 44, 217, 216, 266/265, 268, 270, 281, 236; 222/591

[56] References Cited

U.S. PATENT DOCUMENTS

| | | | |
|---|---|---|---|
| 2,421,276 | 5/1947 | Lotz | 29/244 |
| 3,551,989 | 1/1971 | Tinnes | 29/252 |
| 4,720,211 | 1/1988 | Streatfield et al. | 29/234 |
| 5,060,915 | 10/1991 | Altpeter et al. | 222/591 |

*Primary Examiner*—Scott Kastler
*Attorney, Agent, or Firm*—Harold I. Masteller, Jr.

[57] ABSTRACT

A method and apparatus for inserting a nozzle into the discharge bore of a steelmaking vessel including a carriage and a clamp means for demountably attaching the nozzle to the carriage. The apparatus further includes means to move the carriage toward or away from the steelmaking vessel while at the same time rotating the nozzle about its longitudinal axis as it is pressed into the discharge bore.

26 Claims, 9 Drawing Sheets

METHOD AND APPARATUS FOR INSTALLING A NOZZLE INSERT IN A STEELMAKING LADLE

This application is a continuation-in-part of application Ser. No. 08/025,534, filed Mar. 3, 1993, now U.S. Pat. No. 5,335,896, granted Aug. 9, 1994.

BACKGROUND OF THE INVENTION

This invention relates to ladle nozzle inserts and in particular to installation tools for accurately positioning and fastening nozzle inserts within the discharge bore of a steelmaking ladle.

Today's state of the an steelmaking ladles include complex apparatus for dispensing the molten metal from a discharge bore located in the bottom of the ladle. This apparatus often includes a replaceable nozzle insert shaped to engage a slide gate valve used to control the flow of the molten metal. Such interacting components make it necessary to accurately place the nozzle inserts within the discharge bore of the ladle to permit correct alignment between the insert and the mechanism of the slide gate valve. Failure to properly seat a nozzle insert to an exact depth within a discharge bore will cause interference between the insert and the slide gate valve. Forces required to operate the valve will smash any misaligned refractory parts of the insert which don't intermesh with the valve mechanism, and the nozzle insert service life will be greatly reduced. In addition, interference between the nozzle insert and its slide gate valve can cause the valve to jamb and create a "running stop", an emergency which often floods the shop with molten metal and usually requires a shutdown of the steelmaking operations.

Along with the need to properly position a nozzle insert within a discharge bore of a well block, it is also necessary to provide a continuous mortar joint, free of voids or gaps, between the outside surface of the nozzle insert and the wall of the discharge bore. Substandard mortar joints, those having voids or gaps, permit molten steel to seep between the nozzle insert and the ladle lining and cause premature nozzle failure, damage to the slag sensors adjacent the discharge nozzle, and damage to the slide gate mechanism.

SUMMARY OF THE INVENTION

It is therefore an object of this invention to provide a nozzle insert tool which simplifies the installation of a nozzle insert within the discharge bore of a ladle.

It is a further object of this invention to provide a nozzle insert tool which will accurately position and seat a nozzle insert to a required depth within a discharge bore of a ladle.

It is still a further object of this invention to provide a nozzle insert tool which will facilitate the application of a continuous, void free, layer of adhesive between the outside surface of a nozzle insert and the wail of a discharge bore.

And finally, it is an object of this invention to provide a method for applying a continuous void free adhesive joint between the outside surface of a nozzle insert and the wail of a discharge while accurately positioning and to seating the nozzle insert to a required depth within the discharge bore.

DETAILED DESCRIPTION OF THE PREFERRED EMBODIMENT

Figure 11:
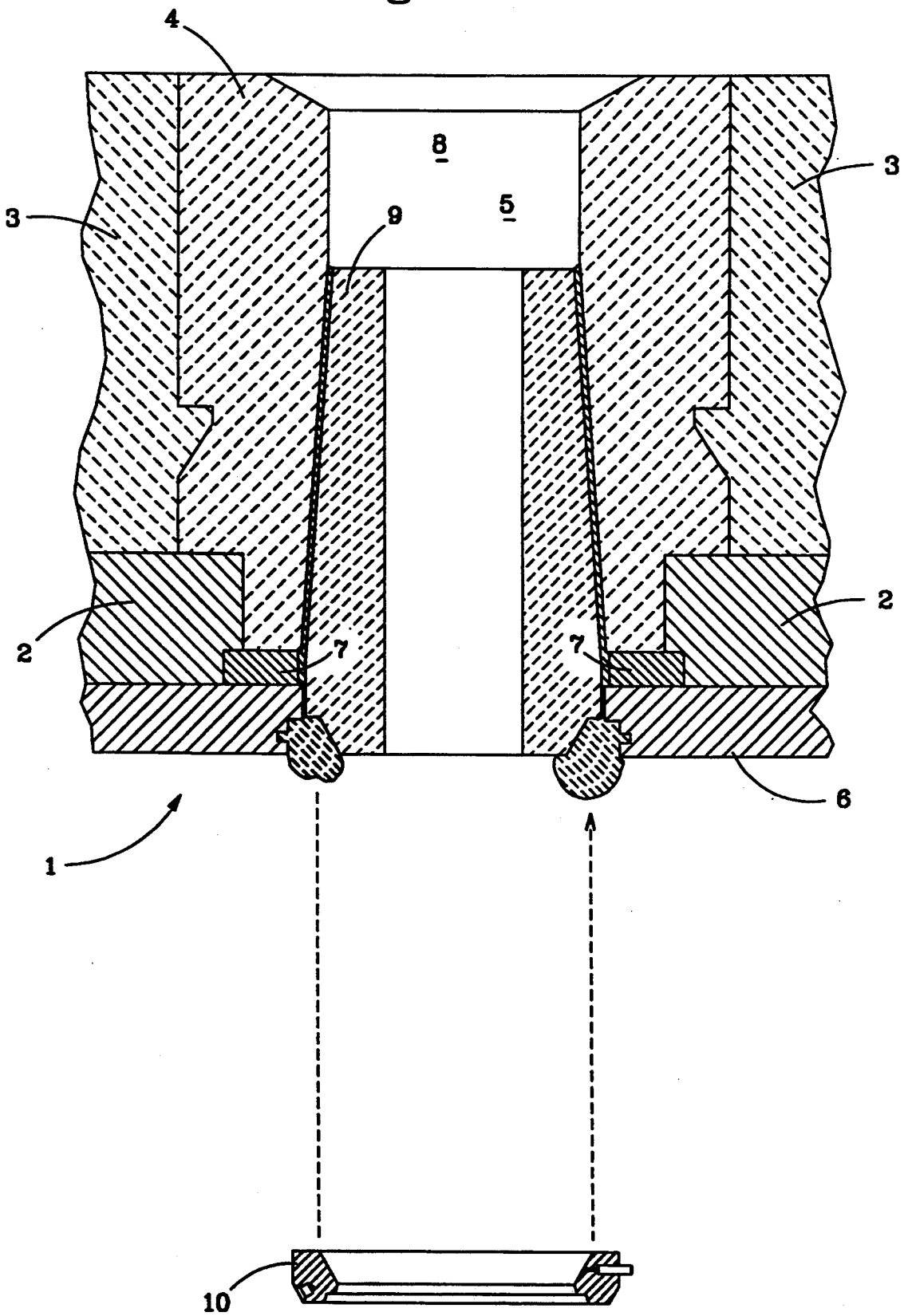
FIG. 11 is a cross-sectional view showing the final installation step for a two piece refractory/steel nozzle insert placed within a discharge bore.

Modern, state of the art ladles often include electromagnetic slag sensors to provide an indication of the onset of slag during the teeming of the ladle. As shown in FIG. 11 of the drawings, the bottom portion of such modern ladles 1 comprise an outside shell 2 protected by a refractory lining 3 which includes a well block 4 and a replaceable nozzle insert 5. A mounting plate 6, attached to the outside surface of shell 2, provides a planer surface for mounting a slide gate valve (not shown), used to control the discharge of molten metal during teeming operations. A slag sensor 7, installed above the slide gate mounting plate 6, encircles a discharge bore 8 at a strategic position for detecting the presence of slag.

It has been found that the moving components of a slide gate vane can damage the refractory face of a nozzle insert and reduce service life of the insert. Such damaged nozzle inserts alter the flow pattern of the nozzle stream and, at times, spray molten metal throughout the shop. In order to overcome these problems, two piece refractory/steel nozzle inserts have been developed to provide a heat resistant refractory portion 9 for insertion deep into the discharge bore of the ladle, and a steel portion 10 for engagement with the slide gate valve mechanism. It has also been discovered that if the steel portion 10 is positioned within the discharge bore at a location adjacent the slag sensor, it will adversely affect the electromagnetic field and accuracy of the slag sensor. This magnetic interference reduces sensor sensitivity and results in a loss of product quality.

As disclosed in U.S. application Ser. No. 08/025,543, a two piece refractory/steel nozzle assembly can eliminate such sensor interference problems because it provides a nonmagnetic refractory piece 9 inserted within the discharge bore 8 adjacent slag sensor 7, and a steel lockring portion 10 fastened within mounting plate 6 positioned below the electromagnetic field. Although such nozzle assemblies reduce or eliminate magnetic interference, it has been found that they cause erratic slide gate valve operation if the refractory portion 9 is not accurately placed and seated at a predetermined depth within the discharge bore. Failure to properly seat the refractory portion causes improper alignment between steel lockring 10 and the valve mechanism, and results in a jammed or stuck slide gate valve.

And finally, we have also discovered that a continuous void free mortar joint can be formed between the outside surface of a nozzle insert and a ladle discharge bore if the refractory piece is rotated about its longitudinal axis as it is inserted into the discharge bore.

Figure 1:
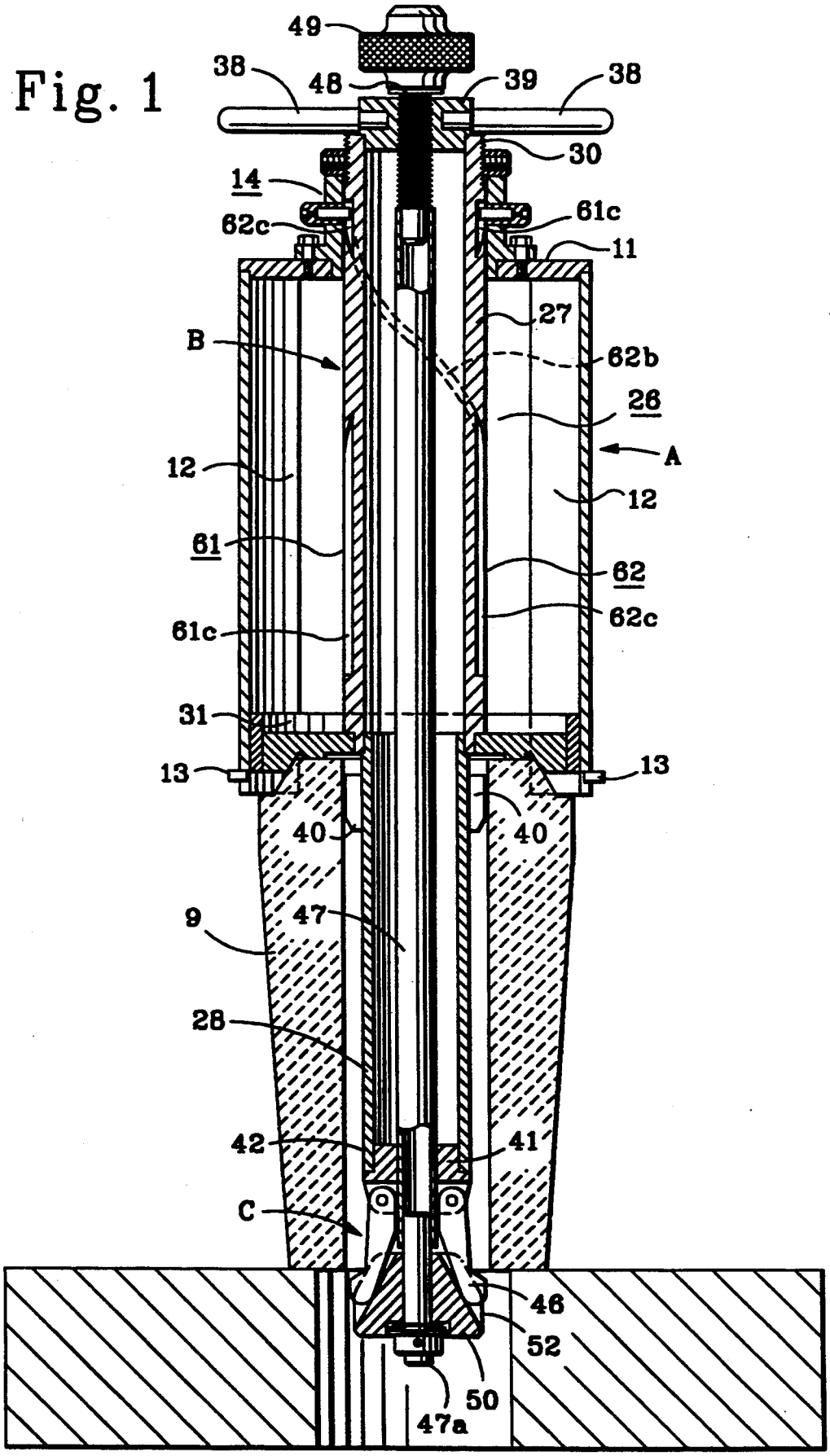
FIG. 1 is a cross-sectional view of the preferred embodiment of a nozzle insert tool placed upon a refractory piece.
Figure 2:
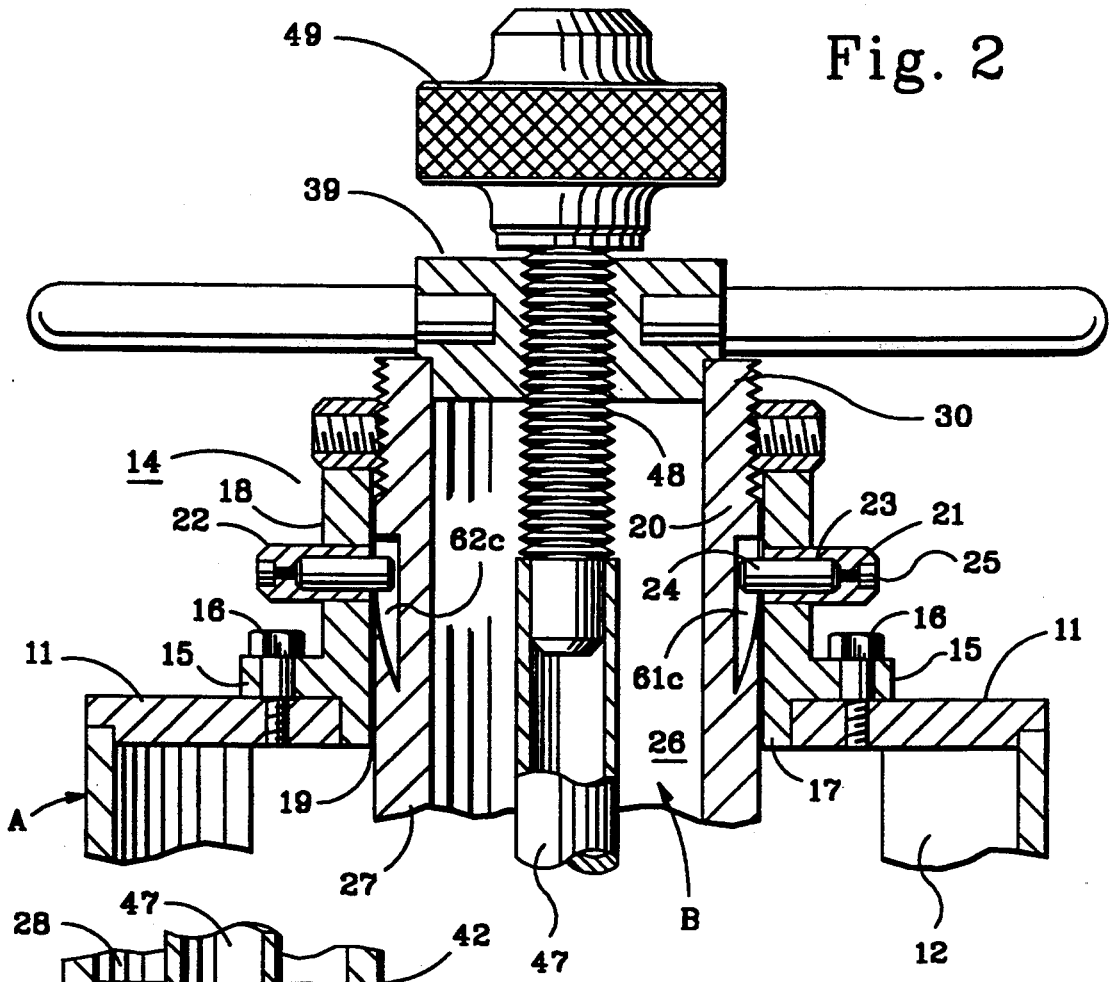
FIG. 2 is an enlarged cross-sectional view of one end of the preferred embodiment.

Referring to FIG. 1 of the drawings, a nozzle insert tool is shown placed upon refractory piece 9, of a nozzle insert, being prepared for placement within the discharge bore of a ladle. The tool comprises a support frame "A", a moveable carriage "B" for positioning and seating refractory piece 9 within a ladle discharge bore, and a nozzle clamp "C" for attaching the refractory piece to carriage "B".

Support frame "A" comprises a mounting platform 11 and at least two side walls 12, each side wall having one end connected to mounting platform 11 and extending in a downward direction therefrom. A radially extending pin 13 is fastened to the other end of each side wall, and the pin extends outward to provide a lock means for attaching the support frame "A" to a ladle. Two spaced apart side walls 12 are use in the preferred embodiment to reduce the weight of the nozzle insert tool. It should be understood, however, that a single side wall having a continuous surface could be used for support frame "A" without departing from the scope of this invention.

Support frame "A" further includes a support collar 14 for guiding moveable carriage "B" along the longitudinal axis of the nozzle insert tool. As more clearly shown in the enlarged drawing of FIG. 3, support collar 14 includes a flange 15 attached to mounting platform 11 by fasteners 16. A lower end 17 of collar 14 extends downward from flange 15 into an aperture provided through the mounting platform, and a second, opposite end 18, extends in an upward direction from flange 15. Bore 19, adapted to receive carriage "B" and provide a running surface for moving carriage "B" in a longitudinal direction, extends from lower end 17 to second end 18.

Collar 14 further includes cam followers 21 and 22 positioned between flange 15 and upper end 18 of the collar and extending outward from wall 20 of collar 14. One end of each cam follower includes a hollow portion 23 to receive a pin or bearing 24, and the opposite end is threaded to receive a machine screw 25. The machine screw communicates with pin 24 to provide means for adjusting the pin or beating toward or away from bore 19.

Carriage "B" provides meters to press the nozzle refractory piece into the discharge bore of a ladle and comprises a guide beam 26, a nozzle clamp assembly "C", and depth adjustment means 29.

Figure 4:
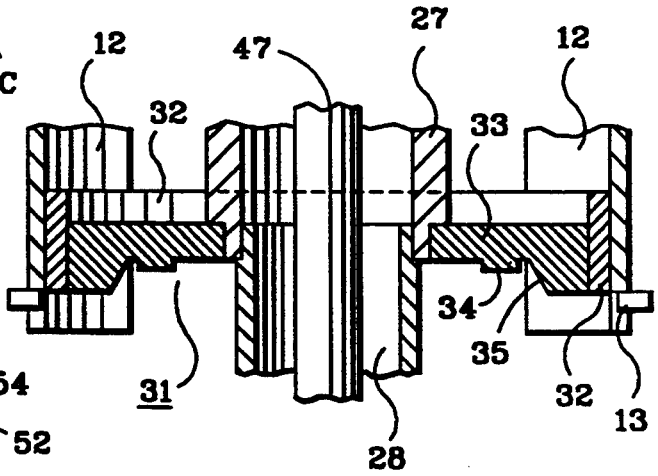
FIG. 4 is an enlarged cross-sectional view showing a gauge plate for setting penetration depth.

Guide beam 26 includes an upper segment 27 supported within bore 19 of collar 14, and a lower segment 28 fastened to nozzle clamp assembly "C". Upper segment 27 includes a threaded end 30 for receiving depth adjustment means 29, and an opposite end attached to a gauge plate 31. As shown more clearly in FIG. 4, gauge plate 31 includes a guide brace 32 having a surface contiguous with the inside surface of side walls 12, and a nozzle support pad 33 having a raised portion 34 and a bevel portion 35 for supporting a refractory piece 9 clamped between nozzle clamp assembly "C" and gauge plate 31.

Adjustment means 29 governs the depth of penetration into the discharge bore of the ladle and includes a stop ring 36 provided with set screws 37. The stop ring is adjustable along the length of threaded end 30 and set screws 37 fasten the stop ring to a selected position along the threads to regulate the length of the downward stroke of guide beam "B". Handle 38 attached to end plug 39 provides means for supplying power to move carriage "B" in either direction along the longitudinal X—X axis of the tool.

Slots or cams 61 and 62 formed within upper segment 27 correspond with cam followers 21 and 22 extending through wall 20 of collar 14. Cams 61 and 62 extend longitudinally along the outside surface of upper segment 27 between threaded end 30 and gauge plate 31, and the cams are adapted to receive bearings 24 from their respective followers. Slot 61 includes a first end **61*a* parallel to axis X—X of the insert tool, a second end 61*c* also parallel to axis X—X but located opposite or 180° from first end 61*a*, and a helical section 61*b* extending between ends 61*a* and 61*c*. Slot 62 includes a first end 62*a* parallel to axis X—X and positioned opposite or 180° from first end 61*a*, a second end 62*c* also parallel to axis X—X but located opposite or 180° from first end 62*a*, and a helical section 62*b* extending between ends 62*a* and 62*c***.

Slot 61 is adapted to receive bearing 24 of cam follower 21 and slot 62 is adapted to receive bearing 24 of cam follower 22. As carriage "B" is moved in either its upward or downward stroke along the X—X axis, bearings 24 follow the cams and rotate carriage "B" 180° as it moves through the length of its stroke.

Although the preferred embodiment of this invention discloses two cams for rotating carriage "B" 180°, it should be understood that one or more cams may be used to rotate the carriage and the degree of rotation may be changed without departing from the scope of this invention.

One end of lower segment 28 is attached to upper segment 27 and the opposite end 42 is attached to nozzle clamp "C" to provide means to clamp and hold a refractory piece against gauge plate 31. Spacers 40 extend outward from lower segment 28 to stabilize the lower segment within the bore of refractory piece 9 clamped between nozzle clamp "C" and gauge plate 31.

Figure 3:
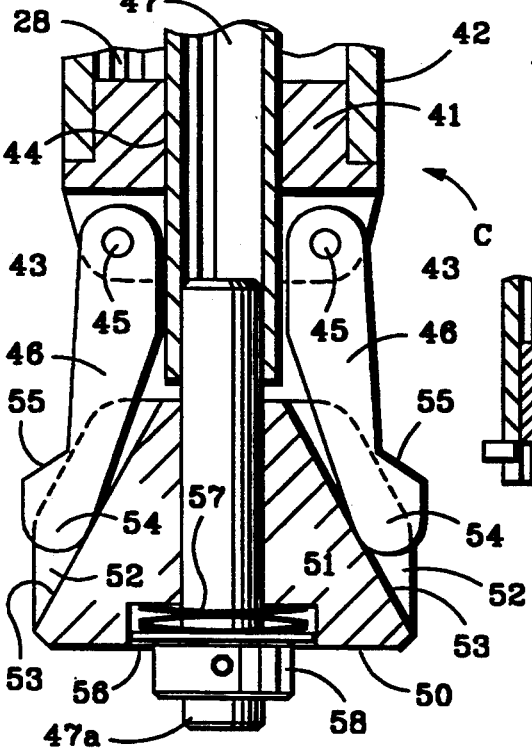
FIG. 3 is an enlarged cross-sectional view of the end opposite FIG. 2 showing a clamp means.

As shown more clearly in FIG. 3, nozzle clamp "C" includes a shackle plug 41 attached to opposite end 42 of the lower segment 28 of the guide beam. At least two spaced apart plates 43 extend in a downward direction from shackle plug 41, and the plates positioned adjacent bore 44 extending through the shackle plug. Each plate 43 includes an aperture for receiving a pivot pin 45 to pivotally attach a clamp jaw 46 thereto.

An elongated connecting rod 47 extends through carriage "B". One end of connecting rod 47 includes a threaded end 48 and engages a threaded bore extending through end plug 39 attached to the upper segment 27 of carriage "B". Adjustment knob 49 is attached to end of connecting rod 47 extending outward from end plug 39 and provides means for rotating threads 48 within the bore of the end plug. The opposite end of the connecting rod extends through bore 44 and includes a reduced portion 47*a* which is captured within aperture 51 extending through expansion wedge 50. Bore 44 provides a sliding fit with connecting rod 47 to enable connecting rod 47 to move longitudinally along the X—X axis of the nozzle insert tool as the threads 48 are rotated.

Expansion wedge 50 includes slots 52 arranged to correspond with the clamp jaws 46 extending downward from shackle plug 41. Each slot 52 includes an inclined surface 53 for engaging a rounded end portion 54 of the clamp jaws, and each rounded end 54 includes a gripping surface 55 for clamping the refractory piece against gauge plate 31. The rounded end portions of clamp jaws reduce friction as the clamp jaw moves along inclined surface 53 and promotes smooth rotation of jaws 46 to their open and closed positions.

The clamp jaws are rotated outward to engage and clamp refractory piece 9 against gauge plate 31. As knob 49 is turned to rotate threaded end 48, connecting rod 47 and the attached expansion wedge 50 move in a direction to engage the expansion wedge with the clamp jaws. The inclined surface 53 of slots 52 force clamp jaws 46 to rotate in an outward direction and the gripping surfaces 55 of jaws 46 engage refractory piece 9. Adjustment knob 49 is further rotated to clamp the refractory piece between jaws 46 and gauge plate 31.

A set of compression washers or other like spring devices 57 is sandwiched between fastener 58, attached to the reduced portion 47*a* of the connecting rod, and expansion wedge 50. The compression washers 57 are retained within indentation 56 formed within the expansion wedge. After the refractory piece has been clamped between clamp jaws 46 and gauge plate 31, connecting rod 47 is given added tarns to compress the washers to increase their spring tension and add to the gripping force of the clamp jaws 46. Additionally, the compressed washers provide a more uniform distribution of the clamping forces being transmitted to the gripping surfaces 55 of the clamp jaws. This more uniform distribution of clamping forces helps prevent misalignment of the clamped refractory piece if the nozzle insert tool is accidently bumped or dropped.

Referring once again to FIGS. 1–4 of the drawings, in order to install a two piece refractory/steel nozzle insert within a discharge bore, the correct penetration depth of the refractory piece must first be established to prevent jamming of the slide gate valve mechanism. Given the correct depth information, set screws 37 are loosened and stop ring 36 is rotated to a selected position along threaded end 30 of carriage "B". This calibrates the full length of the downstroke for carriage "B". Set screws 37 are tightened to prevent further rotation of the stop ring, and adjustment knob 49 is rotated to close clamping jaws 46 prior to insertion through the bore of the refractory piece being prepared for installation.

As shown in FIG. 1, although it is not an essential feature of this invention, we have found that it is convenient to provide a work surface 59 having a recessed portion 60 for receiving nozzle clamp assembly "C" extending from one end of refractory piece 9. A refractory piece 9 is positioned over recess 60 with its slide gate engaging portion in the up position and the lower segment 28 of carriage "B" is lowered into the bore of refractory piece 9 until the raised portions 34 of gauge plate 31 rest upon the slide gate 9*a* surface of the refractory piece. The length of lower segment 28 is designed such as to enable the rounded jaw portions 54 of nozzle clamp assembly "C" to extend from the refractory piece bore and into recess 60.

With the insert tool supported upon the refractory piece, adjustment knob 49 is rotated in a direction to engage expansion wedge 50 with the clamp jaws 46. Adjustment knob 46 is rotated until gripping surfaces 55 of the clamp jaws engage the refractory piece, washers 57 are compressed, and the refractory piece is firmly clamped between clamp jaws 46 and gauge plate 31.

Figure 5:
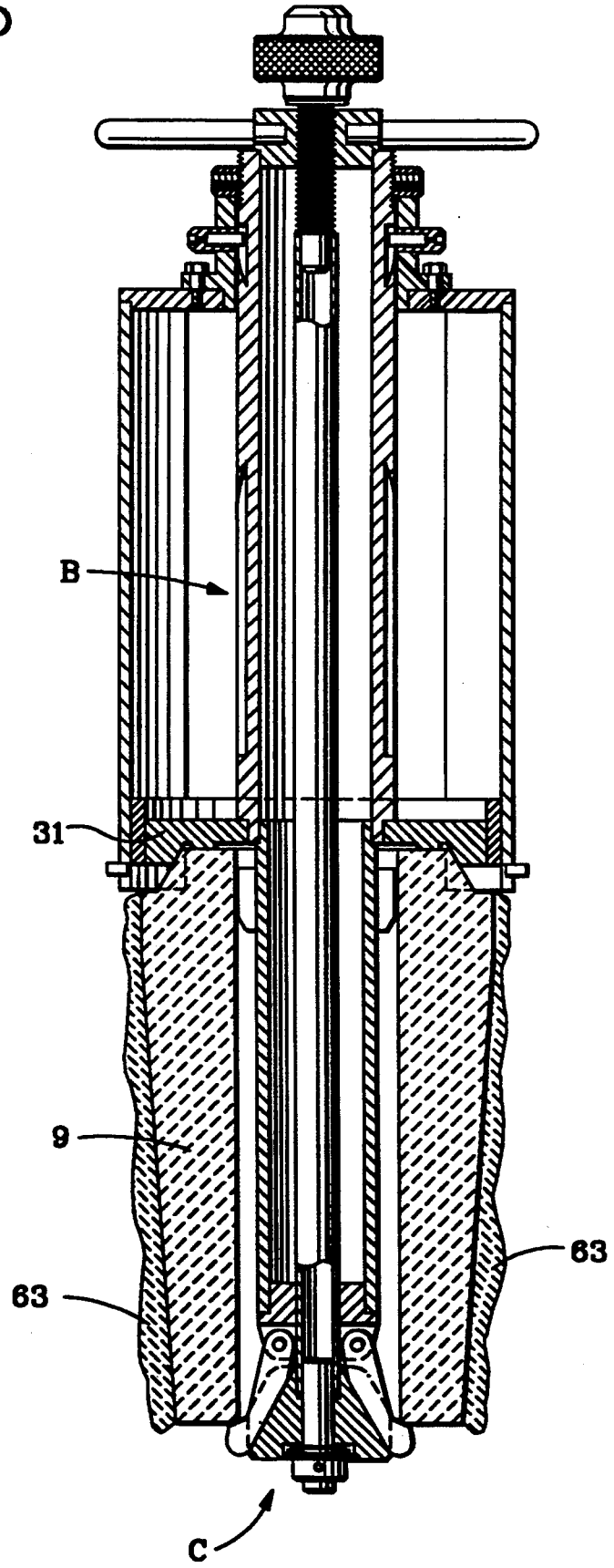
FIG. 5 is a cross-sectional view similar to FIG. 1 showing a refractory piece held in place by the clamped means.

As shown in FIG. 5, the insert tool can now be picked up and carried about with refractory piece 9 held firmly in place between nozzle clamp assembly "C" and gauge plate 31 of carriage "B". The outside surface of refractory piece 9 is coated with mortar 63 to provide a bonding material to fasten the refractory piece to the inside wall of the ladle discharge bore.

Figure 6:
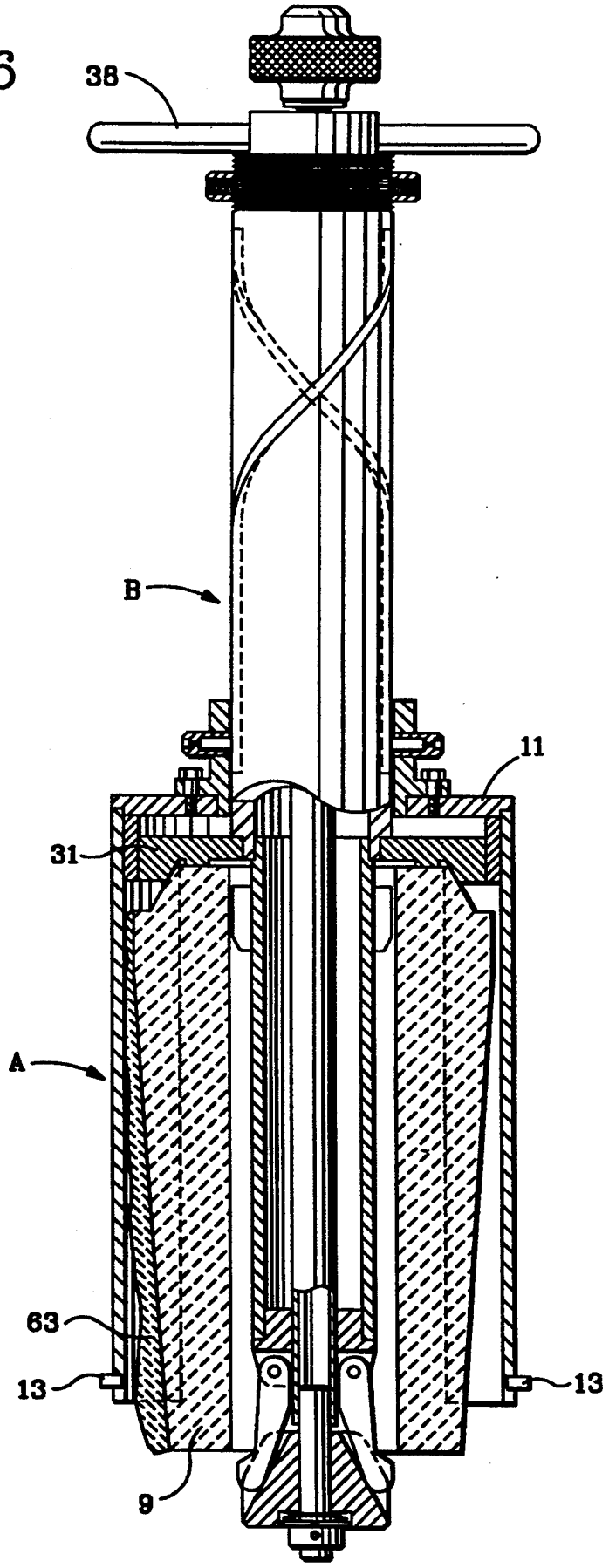
FIG. 6 is a cross-sectional view showing the refractory piece housed within the insert tool prior to insertion into a discharge bore.
Figure 7:
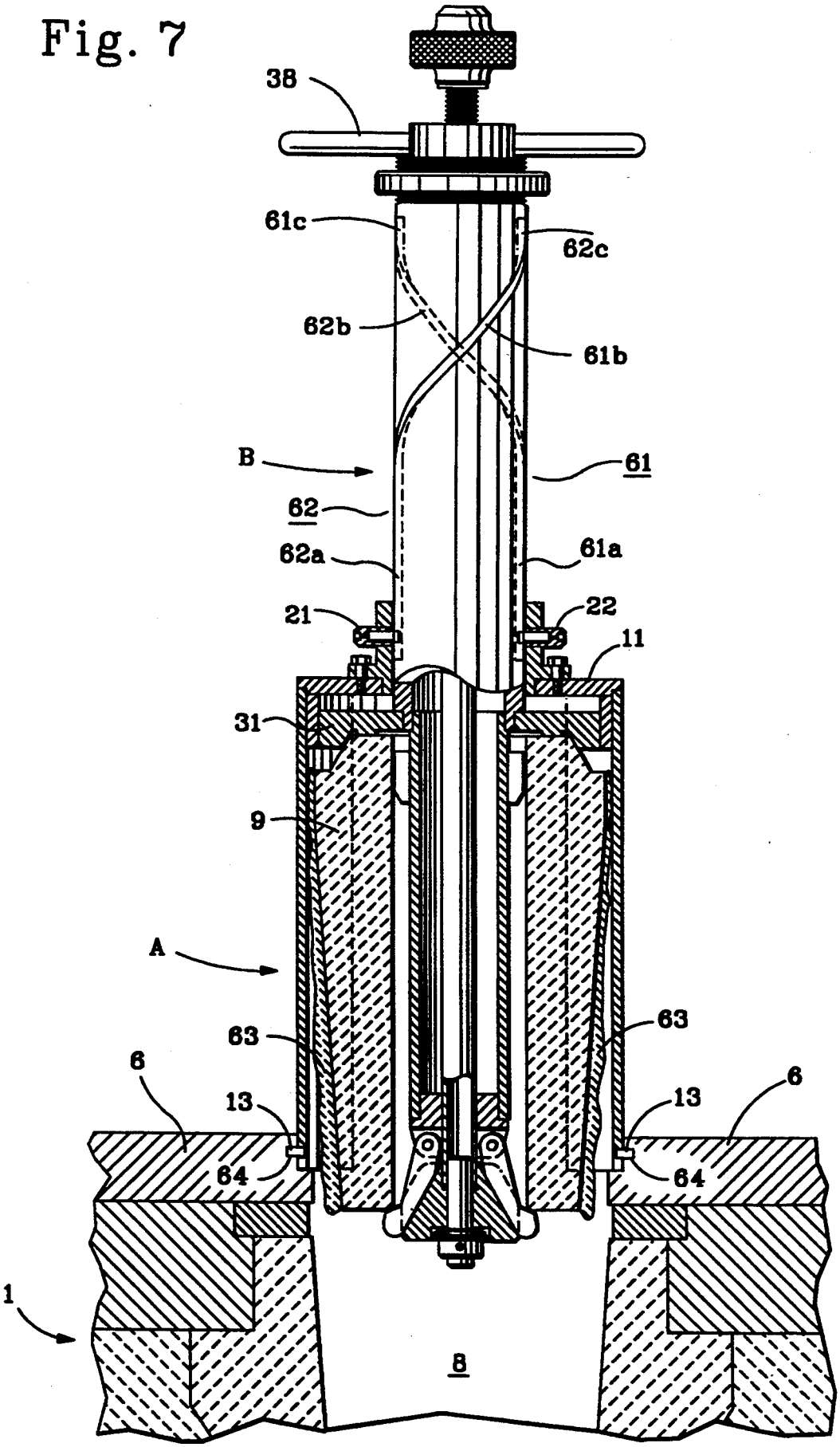
FIG. 7 is a cross-sectional view showing the nozzle insert tool aligned and fastened to a ladle.

As shown in FIGS. 6 and 7 of the drawings, the mortar coated refractory piece 9 is placed within support frame "A" by applying an upward force against handle 38 until carriage "B" completes its upstroke with gauge plate 31 positioned against the bottom surface of mounting platform 11. Support frame "A" is then attached to the slide gate mounting plate 6 of ladle 1 by inserting and fastening lock pins 13 within circumferential grooves 64 cut into the bore wall of mounting plate 6 as described in U.S. application Ser. No. 08/025,534 for fastening the steel lockring of a two piece refractory/steel nozzle insert. The nozzle insert tool has now been calibrated and locked into positioned on the ladle to press refractory piece 9 into the discharge bore.

Figure 8:
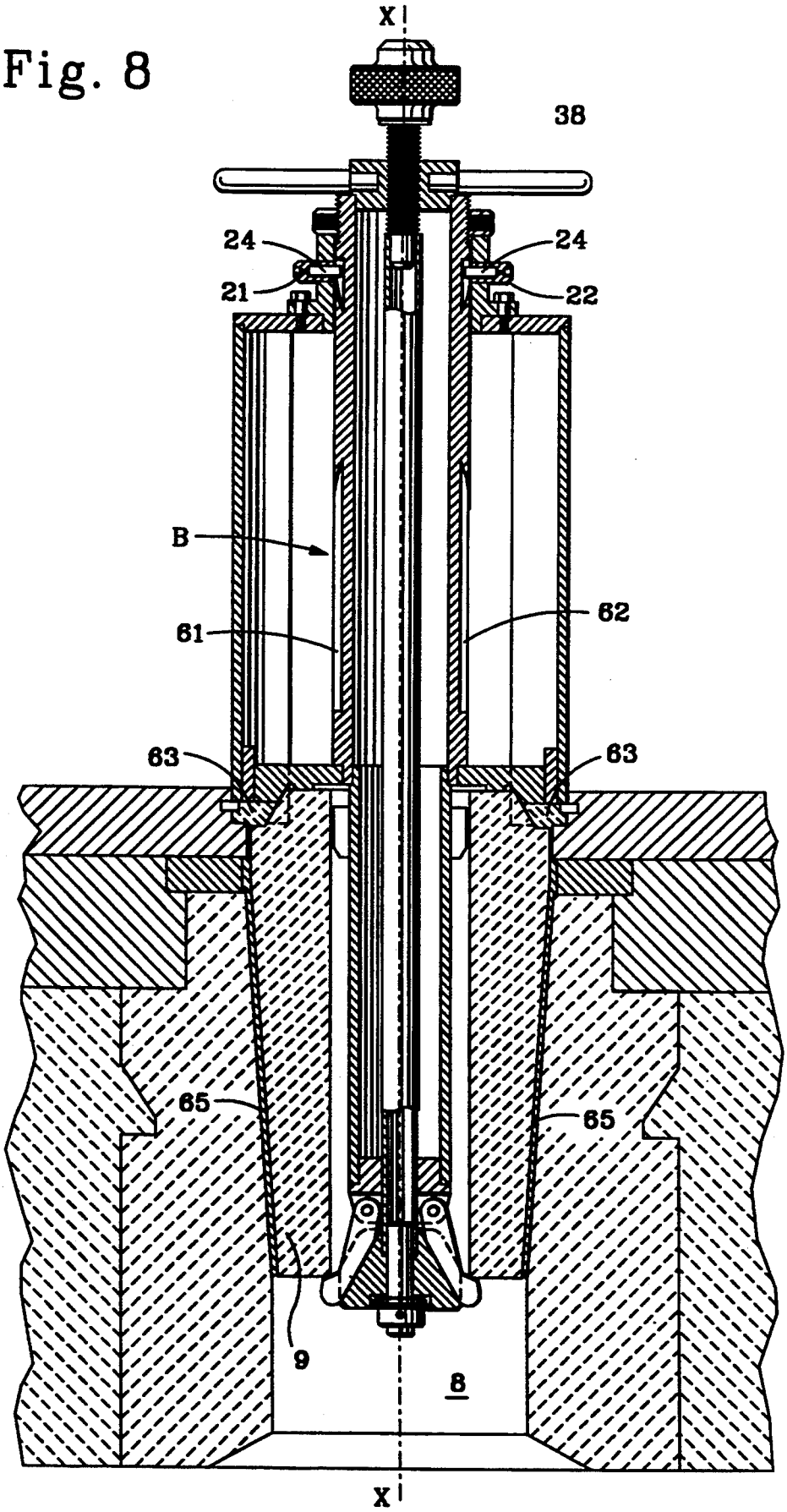
FIG. 8 is a cross-sectional view showing the refractory piece positioned within the discharge bore of the ladle.

As shown in FIG. 8, a downward force is applied to handle 38 to drive carriage "B" along its downstroke and press refractory piece 9 into discharge bore 8. As carriage "B" moves along the X—X axis toward discharge bore 8, bearings 24 of the cam followers trace the paths of slots 61 and 62, and helical portions 61*b* and 62*b* rotate the refractory piece 9 as it is pressed into the discharge bore. A comparison of the drawings will show that the positions of cams 61 and 62 are reversed after carriage "B" has moved from its upstroke position, shown in FIG. 7, to its downstroke position shown in FIG. 8.

It has been discovered that rotation of refractory piece 9 as it is pressed into bore 8 causes the mortar coating 63 to be uniformly spread within the mortar joint space 65 provided between the refractory insert 9 and the discharge bore wall. It has also been found that the combined rotational and linear motion during the insertion of refractory piece 9 causes the mortar coating to be spread in a manner which eliminates voids or gaps within mortar joint 65, and prevents premature nozzle failure as heretofore described.

Figure 9:
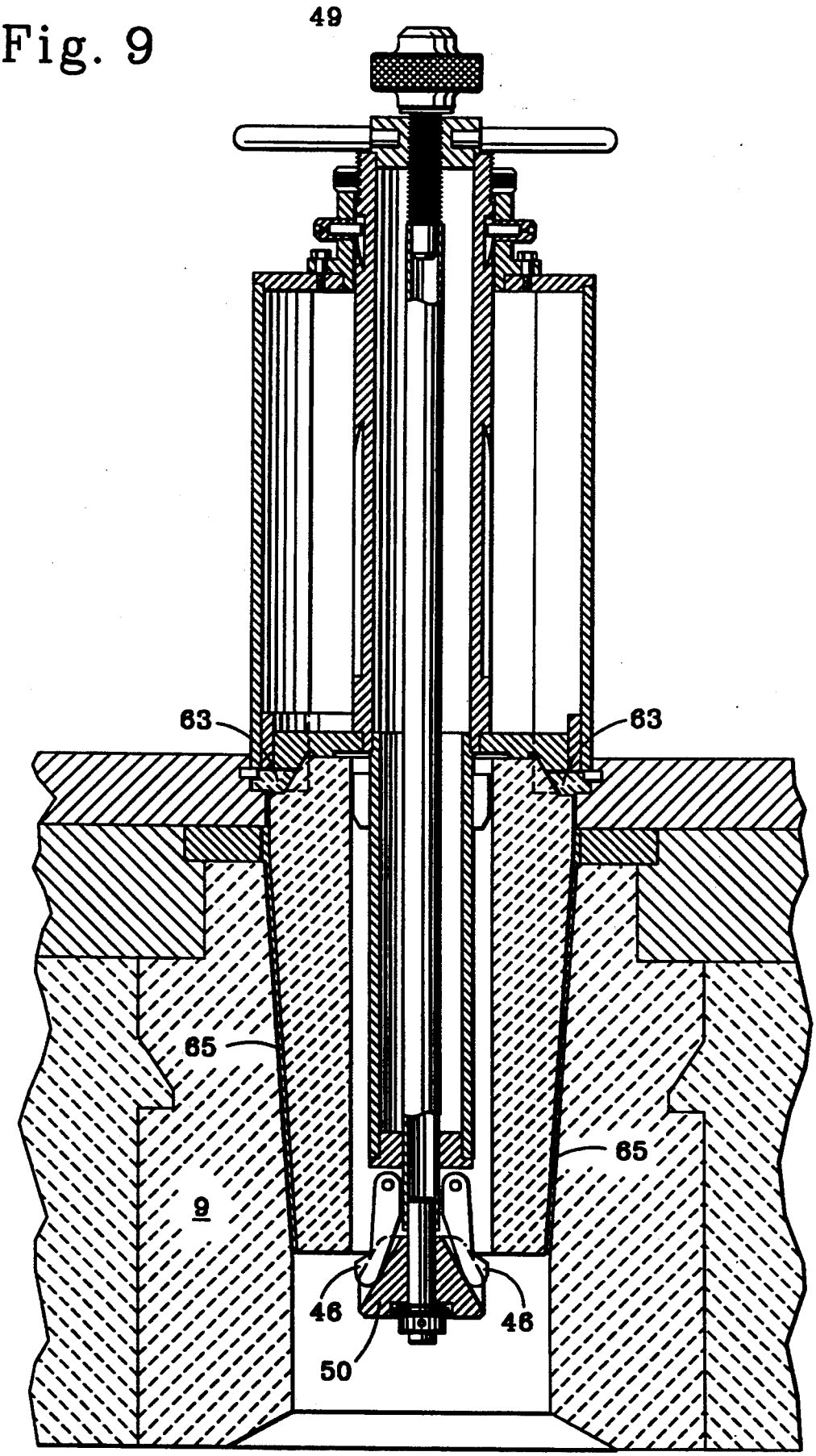
FIG. 9 is a cross-sectional view showing the clamp means disengaged.

Referring to FIG. 9, adjustment knob 49 is rotated to move expansion wedge 50 in a direction away from clamp jaws 46, and the clamp jaws rotate to their closed position releasing their grip upon the top surface of refractory piece 9. The rotation of clamp jaws 46 to their closed position can be assisted with a variety of biasing mechanisms well known in the art such as torsion springs.

Figure 10:
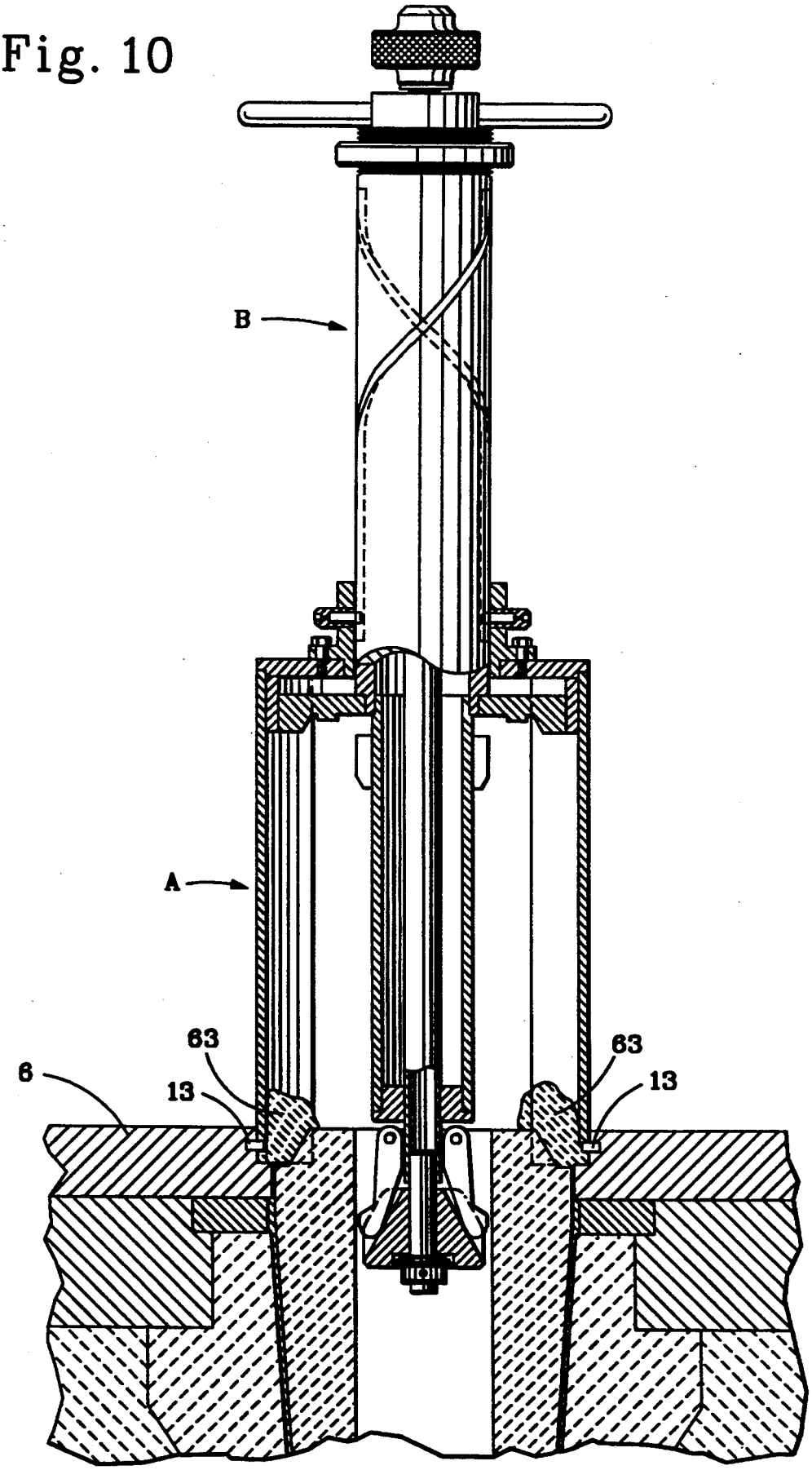
FIGS. 10 is a cross-sectional view showing the carriage in its retracted position with the refractory piece positioned within the discharge bore.

Carriage "B" is extended to its full upstroke position, as shown in FIG. 10, to avoid damaging or moving the refractor/piece when the insert tool is removed from mounting plate 6 of the ladle. Support frame "A" is rotated to remove lock pins 13 from their fastened position within the locking grooves of mounting plate 6. The tool is removed from the face of the mounting plate and the steel lockring 10 of the two piece refractory/- steel nozzle insert, shown in FIG. 11, is locked within the bore of mounting plate 6 to prevent the refractory piece from falling out of the discharge bore when ladle 1 is inverted to its upright position.

While this invention has been illustrated and described in accordance with a preferred embodiment, it is recognized that variations and changes may be made therein without departing from the scope of the invention as set forth in the claims.

We claim:

1. Apparatus for inserting a nozzle into the discharge bore of a steelmaking vessel, comprising:

a) a support frame, b) a carriage attached to said support frame, said carriage having means to move in a longitudinal direction along an X—X axis, c) means to demountably attach said nozzle to said carriage, and d) means including a cam to move said carriage in said longitudinal direction to insert said nozzle into said discharge bore, said cam simultaneously imparting a fixed amount of rotation to said nozzle in said discharge bore.

2. The invention recited in claim 1 wherein said apparatus includes means to limit said longitudinal movement along said X—X axis.

3. The invention recited in claim 1 wherein said carriage support includes means to demountably attach said apparatus to said steelmaking vessel.

4. Apparatus for inserting a nozzle into the discharge bore of a steelmaking vessel, comprising:

a) a carriage and a support frame, said support frame having a bushing end to receive said carriage and at least one sidewall extending from said bushing end, said carriage extending through a bore in said bushing end and including a gauge plate having a surface contiguous with an inside surface of said side wall of said support frame, said carriage having means to move in a longitudinal direction along an X—X axis, c) means to demountably clamp said nozzle to said gauge plate, and d) means including a cam to move said carriage in said longitudinal direction to insert said nozzle into said discharge bore, said cam simultaneously imparting a fixed amount of rotation to said nozzle in said discharge bore.

5. The invention recited in claim 4 wherein said apparatus includes means to adjust the position of said gauge plate along said X—X axis to control nozzle penetration depth within said discharge bore.

6. The invention recited in claim 4 wherein said carriage is moved in said longitudinal direction by a force applied to one end of said carriage to cause said carriage to slide within said bushing end of said support frame and said gauge plate to slide along said inside surface of said sidewall, said force capable of being applied in a direction toward said discharge bore or in a direction away from said discharge bore.

7. The invention recited in claim 4 wherein said means to rotate said nozzle about said X—X axis comprises at least one cam including;

a) a slot formed in said carriage, said slot having a helical portion, and b) a cam follower fastened to said support frame and extending into said slot formed in said carriage, said cam follower positioned to force said carriage to rotate about said X—X axis in response to said cam follower tracking said helical portion as said carriage is moved in said longitudinal direction.

8. The invention recited in claim 7 wherein said helical portion extends between a first slot portion parallel to said X—X axis and a second slot portion parallel to said X—X axis.

9. The invention recited in claim 7 wherein said helical portion forces said carriage to rotate 180° about said X—X axis.

10. The invention recited in claim 4 wherein said means to demountably clamp said nozzle to said gauge plate comprises;

a) an elongated member threaded at one end to said carriage and the opposite end extending through said carriage and attached to an expansion wedge, the threaded end providing means to move said elongated member in a longitudinal direction along said X—X axis, and b) at least two rotatable clamp jaws positioned to engage said expansion wedge.

11. The invention recited in claim 10 wherein said expansion wedge includes a compression means positioned between a fastener attached to said elongated member and a surface of said expansion wedge.

12. The invention recited in claim 11 wherein said compression means is at least one spring.

13. The invention recited in claim 10 wherein said rotatable clamp jaws are pivotally attached to said carriage, and said clamp jaws engage said expansion wedge when said elongated member is rotated to move in said longitudinal direction away from said discharge bore, and disengage said expansion wedge when said elongated member is rotated to move in said longitudinal direction toward said discharge bore.

14. The invention recited in claim 4 wherein said wedge includes at least two slots, each slot having an inclined surface to engage a said clamp jaw.

15. The invention recited in claim 5 wherein said means to adjust the position of said gauge plate along said X—X axis comprises;

a) a ring threaded to a threaded end portion of said carriage extending outward from said bushing end of said support frame, said ring adjustable along said threaded end portion, and b) at least one fastener extending through said ring and communicating with said carriage, said fastener attaching said ring to said carriage, said ring position to engage said bushing end and limit said longitudinal movement of said carriage toward said discharge bore.

16. A method of inserting a two piece refractory/steel nozzle insert into a discharge bore of a steelmaking vessel having a steel shell and a refractory lining, the two piece refractory/steel nozzle insert having a refractory nozzle and a steel lockring, the steps comprising:

a) demountably attaching said refractory nozzle to a ram portion of a nozzle insert tool, b) coating said refractory nozzle with an adhesive, c) aligning said nozzle insert tool with said discharge bore, d) extending said ram to press said refractory nozzle into said discharge bore, said ram being rotated by a cam, said cam imparting a fixed amount of rotation to said refractory nozzle penetrating said discharge bore, e) detaching said nozzle insert tool from said refractory nozzle inserted into said discharge bore, and f) attaching said steel lockring to said steel shell of said steelmaking vessel.

17. The method of inserting a two piece refractory/-steel nozzle insert into a discharge bore of claim 16 wherein the step demountably attaching said refractory nozzle to said ram includes rotating clamp jaws in a direction to engage said refractory nozzle, said clamp jaws holding said refractory nozzle fast to said ram.

18. The method of inserting a two piece refractory/-steel nozzle insert into a discharge bore of claim 16 wherein the step detaching said nozzle tool from said refractory nozzle inserted into said discharge bore includes rotating clamp jaws in a direction to disengage and release said refractory nozzle.

19. The method of inserting a two piece refractory/-steel nozzle insert into a discharge bore of claim 16 wherein the step extending said ram to press said refractory nozzle into said discharge bore includes rotating said ram with a cam follower extending into a slot formed in said ram, said slot including a helical portion to force said ram to rotate as said cam follower tracks said slot.

20. The method of inserting a two piece refractory/-steel nozzle insert into a discharge bore of claim 16 wherein said ram is rotated at least 180°.

21. The invention recited in claim 1 wherein said fixed amount of rotation is at least 180°.

22. The invention recited in claim 1 wherein said fixed amount of rotation is ≦180°.

23. The invention recited in claim 4 wherein said fixed amount of rotation is at least 180°.

24. The invention recited in claim 4 wherein said fixed amount of rotation is ≦180°.

25. The method of inserting a two piece refractory/-steel nozzle insert into a discharge bore of claim 16 wherein said fixed amount of rotation imparted to said refractory nozzle is at least 180°.

26. The method of inserting a two piece refractory/-steel nozzle insert into a discharge bore of claim 16 wherein said fixed amount of rotation imparted to said refractory nozzle is ≦180°.

* * * * *